US010866604B2

(12) United States Patent
Cornelius et al.

(10) Patent No.: US 10,866,604 B2
(45) Date of Patent: Dec. 15, 2020

(54) LONGITUDINAL VOLTAGE REGULATOR

(71) Applicant: ABB Power Grids Switzerland AG, Baden (CH)

(72) Inventors: Frank Cornelius, Brilon (DE); Martin Carlen, Niederrohrdorf (CH)

(73) Assignee: ABB POWER GRIDS SWITZERLAND AG, Baden (CH)

( * ) Notice: Subject to any disclaimer, the term of this patent is extended or adjusted under 35 U.S.C. 154(b) by 0 days.

(21) Appl. No.: 16/442,577

(22) Filed: Jun. 17, 2019

(65) Prior Publication Data

US 2019/0302814 A1 Oct. 3, 2019

Related U.S. Application Data

(63) Continuation of application No. PCT/EP2017/083141, filed on Dec. 15, 2017.

(30) Foreign Application Priority Data

Dec. 19, 2016 (EP) ..... 16204981

(51) Int. Cl.
*G05F 1/24* (2006.01)
*G05F 1/14* (2006.01)

(52) U.S. Cl.
CPC . *G05F 1/24* (2013.01); *G05F 1/14* (2013.01)

(58) Field of Classification Search
CPC ..... G05F 1/14; G05F 1/24; G05F 1/253
See application file for complete search history.

(56) References Cited

U.S. PATENT DOCUMENTS 5,619,119 A * 4/1997 Pelletier ..... H02J 3/38 323/215
6,737,837 B1 * 5/2004 Halvarsson ..... G05F 1/70 323/205
6,906,476 B1 * 6/2005 Beatenbough ..... H05B 41/40 315/209 R
8,907,530 B1 * 12/2014 Saxton ..... G05F 1/14 307/153
10,147,562 B2 12/2018 Wang
2004/0022077 A1 * 2/2004 Steigerwald ..... H02J 1/02 363/39
2005/0007079 A1 * 1/2005 Champion ..... G05F 1/14 323/257

(Continued)

FOREIGN PATENT DOCUMENTS

CN 1444741 A 9/2003
CN 2814480 Y 9/2006

(Continued)

OTHER PUBLICATIONS

Office Action dated Mar. 26, 2020 for Chinese Patent Application No. 2017800787979, 8 pages.

*Primary Examiner* — Alex Torres-Rivera
(74) *Attorney, Agent, or Firm* — Sage Patent Group

(57) ABSTRACT

A longitudinal voltage regulator includes: a voltage source for generating an additional voltage; and a transformer for coupling the additional voltage into an input voltage. The transformer both generates the additional voltage and couples the additional voltage into the input voltage. In an embodiment, the transformer has an input winding and an output winding.

17 Claims, 2 Drawing Sheets

(56) References Cited

U.S. PATENT DOCUMENTS

| | | | | |
|---|---|---|---|---|
| 2008/0150510 | A1* | 6/2008 | Wong | G05F 1/12 323/301 |
| 2009/0218993 | A1* | 9/2009 | Berggren | H02J 3/1828 323/205 |
| 2012/0206115 | A1* | 8/2012 | Mathewson | G05F 1/14 323/257 |
| 2016/0041568 | A1* | 2/2016 | Daley | G05F 1/14 323/341 |

FOREIGN PATENT DOCUMENTS

| | | | |
|---|---|---|---|
| EP | 3043362 | A1 | 7/2016 |
| WO | WO 2016082704 | A1 | 6/2016 |

* cited by examiner

LONGITUDINAL VOLTAGE REGULATOR

CROSS-REFERENCE TO PRIOR APPLICATION

This application is a continuation of International Patent Application No. PCT/EP2017/083141, filed on Dec. 15, 2017, which claims priority to European Patent Application No. EP 16204981.1, filed on Dec. 19, 2016. The entire disclosure of both applications is hereby incorporated by reference herein.

FIELD

The invention relates to a longitudinal voltage regulator—in particular, for use in a single-phase or multi-phase current distribution network—for example, a medium-voltage network or a low-voltage network.

BACKGROUND

In recent years, the proportion of renewable energy in the supply of electricity has greatly increased. These renewable energies include using photovoltaic systems or other alternative energy sources to generate power. There are regions in which the amount of energy generated is significantly greater than the energy required, so that excess energy must be fed into the existing energy grid and be forwarded to locations where the energy demand is greater than the amount of energy being generated there.

This feeding of energy into the existing electricity distribution network pushes many conventional electricity distribution networks to their limits and requires additional interventions in these conventional electricity distribution networks, wherein these additional interventions are associated with high costs and a great amount of effort.

In particular, in view of the intended shutdown of additional nuclear power plants, it is to be expected that the proportion of renewable energies will continue to increase, so that it is foreseeable that the aforementioned distribution problem will likewise be greater.

European Standard EN 50160 defines the requirements for the voltage in distribution networks and, among other things, dictates that the voltage must remain within +/−10% of the rated voltage.

In general, voltage increases of only 2% presently occur in the supply lines of medium-voltage networks. The exact value of these voltage increases depends upon the settings on the part of the respective grid operators and upon the current load and/or supply situation in the respective supply line.

On longer supply lines, in which feed-ins at different distances or line position feeds are made, the particular predefined planning value for the voltage tolerance can be easily and undesirably exceeded, and there is the necessity of undertaking countermeasures, e.g., disconnecting some of the generators from the network. This can occur more frequently on days in which there is only a comparatively low energy requirement. This means that in many cases supply lines of medium-voltage networks are limited, not because of their capacity, but due to undesired voltage increases. This problem can be reduced by modifying the network architecture. However, this is costly and time-consuming.

Alternatively to a modification of the network architecture, it is possible to use longitudinal voltage regulators in the region of the supply lines of the medium voltage networks.

In present electricity distribution networks, voltage regulation is performed by an HV-MV transformer, which converts a supplied high voltage into a medium voltage. This voltage regulation can ensure that the voltage arriving when loads are connected is in the range of +/−10% of the rated voltage.

If a longitudinal voltage regulator is inserted in the region of the supply lines of the medium voltage network between said HV-MV transformer and the connected loads, then, in this way, a better stabilization of the voltage can be achieved in the region of the supply lines, and, further, the possibility of introducing energy provided by alternative energy sources into the supply lines of the medium voltage network can be improved.

The optimal positioning of a longitudinal voltage regulator depends upon the particular medium voltage network present in each case and upon the feed points of the energy, which is supplied, in particular, by large photovoltaic plants or other alternative energy sources.

In the positioning of a longitudinal voltage regulator, it must, inter alia, also be ensured that, in the case where several supply lines of the medium voltage network are connected to the HV-MV transformer, an exchange of the transformer tapping point used affects all supply lines of the medium voltage network, whereas a longitudinal voltage regulator regulates only the voltage on the supply line on which problems occur. This is particularly important in view of the fact that the feeds occurring on the different supply lines and the loads of the different supply lines can deviate greatly from one another.

A longitudinal tension regulator is usually installed in a housing that is suitable for an outside setup, e.g., in a concrete housing, and must be moved to the desired location of use by means of a flatbed truck because of its dimensions and its weight. If a repositioning of the longitudinal voltage regulator in the region of the medium voltage network is necessary, or additional longitudinal voltage regulators are to be inserted into the medium voltage network, there is a relatively great amount of effort connected with this, because, again, flatbed trucks are required to transport the respective longitudinal voltage regulator to the respective desired location of use. There, it is then set up by a crane on a prepared concrete platform.

SUMMARY

In an embodiment, the present invention provides a longitudinal voltage regulator, comprising: a voltage source configured to generate an additional voltage; and a transformer configured to couple the additional voltage into an input voltage, wherein the transformer is configured both to generate the additional voltage and to couple the additional voltage into the input voltage.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
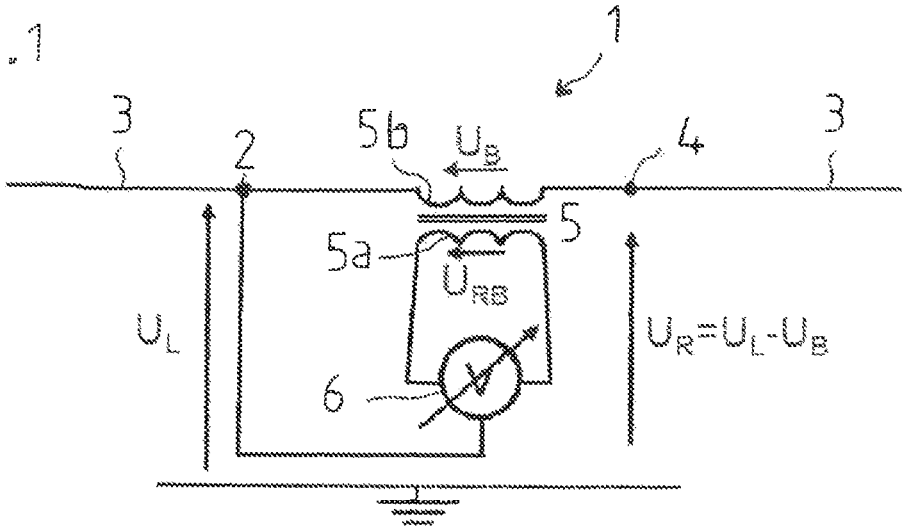
FIG. 1 shows a sketch explaining the basic structure of a longitudinal voltage regulator.

In an embodiment, the present invention provides a longitudinal voltage regulator which has a voltage source for generating an additional voltage and a transformer for coupling the additional voltage into an input voltage, wherein the transformer is designed both for generating the additional voltage and for coupling the additional voltage into the input voltage.

Such a longitudinal voltage regulator has a substantially more compact design than known longitudinal voltage regulators, because it has only one transformer, which is designed to generate the additional voltage and to couple this additional voltage into the supply line. This more compact design allows a reduction in the dimensions of the longitudinal voltage regulator and reduction of its weight. This reduction in weight and dimensions of the longitudinal voltage regulator also reduces the dimensions and weight of the housing in which the longitudinal voltage regulator is installed. This improves the transportability of the longitudinal voltage regulator. In this way such a longitudinal voltage regulator can be transported to the desired installation site also, for example, on the load bed of a regular truck, which means substantially less effort than the transport of a longitudinal voltage regulator on a flatbed truck. At the installation site itself, the housing of the longitudinal voltage regulator, including the longitudinal voltage regulator incorporated therein, is placed on a prepared foundation by means of a crane. Other advantages of a longitudinal voltage regulator according to the invention are that its acquisition costs are lower than the known longitudinal voltage regulator acquisition costs, and that its energy efficiency is significantly increased.

The transformer advantageously has an input winding and an output winding, wherein the output winding is arranged in a supply line. This supply line may be a supply line provided in a medium voltage network or a supply line provided in a low voltage network. Such a supply line may, for example, be assigned to a single-phase electricity distribution network or to one phase of a three-phase electricity distribution network. A three-phase electricity distribution network requires three such power supply lines.

The polarity of the additional voltage is preferably variable. In this way, the desired voltage regulation can be positive and negative. In the former case, the input voltage is superimposed in phase with the additional voltage, so that the additional voltage is added to the input voltage. In the latter case, the input voltage is superimposed in phase opposition to the additional voltage, so that the additional voltage is subtracted from the input voltage.

The change in the polarity of the additional voltage can, advantageously, be effected by a change in the current direction.

According to one embodiment, one terminal of the input winding of the transformer can be connected to a reference potential, and the other terminal of the input winding can be connected to an output terminal of the longitudinal voltage regulator, and one terminal of the output winding of the transformer can be connected to an input terminal of the longitudinal voltage regulator, and the other terminal of the output winding can be connected to the output terminal of the longitudinal voltage regulator. In this embodiment, the additional voltage is superimposed in phase with the input voltage.

According to a further embodiment, one terminal of the input winding of the transformer can be connected to the reference potential, and the other terminal of the input winding can be connected to the input terminal of the longitudinal voltage regulator, and one terminal of the output winding of the transformer can be connected to the input terminal of the longitudinal voltage regulator, and the other terminal of the output winding can be connected to the output terminal of the longitudinal voltage regulator.

According to an advantageous embodiment, the input winding of the transformer can have several taps which are connected to output terminals of a step switch, wherein the input terminal of the step switch is connected to a reference potential. This allows an incremental change in provided additional voltage. This possibility of incremental connection of the additional voltage allows adaptation of the additional voltage to the fluctuation range of the supplied input voltage.

In a preferred embodiment, the input winding of the transformer may have five taps. This number of taps has proven useful and sufficient in practice and offers a good compromise between effort and effect. Alternatively, the number of taps may also be seven, for example.

It has proven advantageous to distribute the positions of the taps non-linearly over the number of turns of the primary winding of the transformer such that a continuous change in the selection of a tap enables a linear change in the additional voltage.

Alternatively, the input winding of the transformer according to another embodiment, wherein no step switch is used, can also be designed without taps.

The functional principle of a longitudinal voltage regulator is to add or subtract an additional voltage to or from an input voltage. The auxiliary voltage is provided using a variable voltage source, which is supplied with power by the supply line. The additional voltage provided by the voltage source is coupled into the supply line using a booster transformer. A longitudinal voltage regulator of this type accordingly regulates the input voltage and couples an additional voltage provided by a voltage source into the input voltage.

FIG. 1 shows a sketch explaining the basic structure described above of a longitudinal voltage regulator. This longitudinal voltage regulator 1 is inserted into a supply line 3 of a medium-voltage network, which is provided, for example, between a (not depicted) high-voltage-to-medium-voltage transformer (HV-MV transformer) and a low-voltage network (likewise not depicted), in which loads are arranged. At the input terminal 2 of the longitudinal voltage regulator 1, there is an input voltage or system voltage $U_L$ subjected to voltage fluctuations. A regulated output voltage or a regulated system voltage $U_R$ is provided at the output terminal 4 of the longitudinal voltage regulator 1. The following applies:

$$U_R = U_L - U_B.$$

$U_B$ is a voltage which drops across the output winding 5*b*, which is inserted into the supply line 3, of a booster transformer 5. This voltage $U_B$ is an additional voltage coupled into the supply line 3. To generate this additional voltage, the longitudinal voltage regulator 1 has a variable voltage source 6 and the booster transistor 3 already mentioned. The voltage source 6 that is supplied with power by the supply line 3 is a variable voltage source, by means of which an additional voltage $U_{RB}$ is generated that is applied to the input winding 5*a* of the booster transformer 5 and, by means of the booster transformer, is coupled into the supply line 3.

Figure 2:
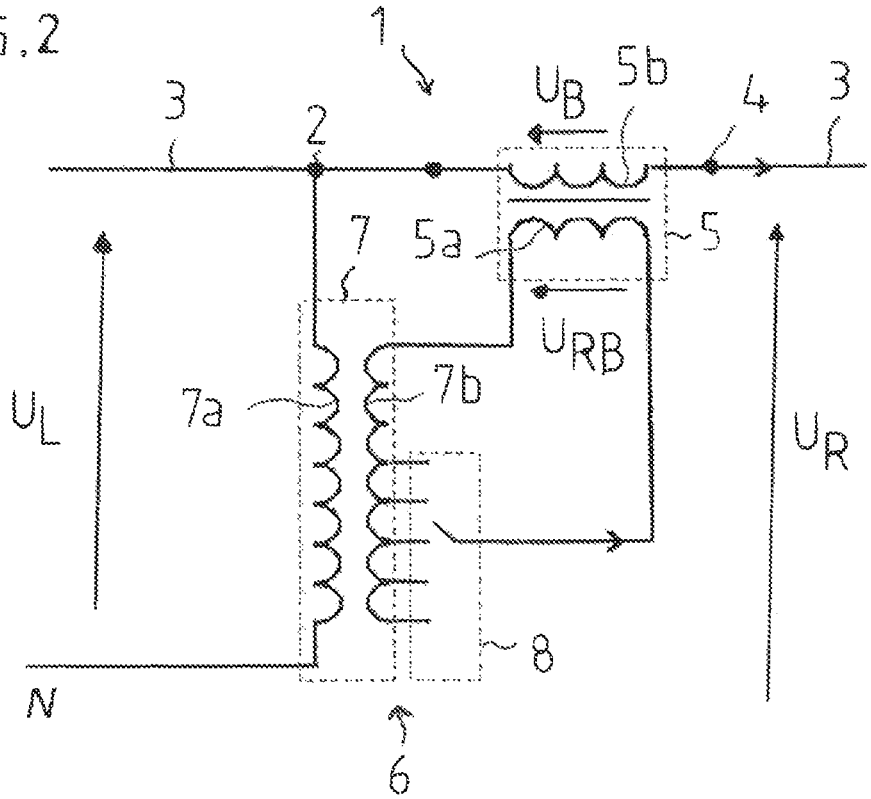
FIG. 2 shows a sketch of a longitudinal voltage regulator, in which the voltage source shown in FIG. 1 is realized by means of a power transformer.

A further transformer, hereinafter referred to as a power transformer, can be used as variable voltage source 6. This is illustrated in FIG. 2. This shows a sketch of a longitudinal voltage regulator in which the voltage source 6 shown in FIG. 1 is formed by such a power transformer 7.

Also in the case of the longitudinal voltage regulator 1 shown in FIG. 2, an input or system voltage $U_L$ subjected to fluctuations is present at the input terminal 2 of the booster transformer 5 on a supply line 3. A regulated output voltage or a regulated system voltage $U_R$ is provided at the output terminal 4 of the longitudinal voltage regulator 1. The following relationship applies to this, just as in FIG. 1:

$$U_R=U_L-U_B.$$

The longitudinal voltage regulator 1 has a variable voltage source 6 and a booster transformer 5. An additional voltage $U_{RB}$ drops across the input winding 5*a*, connected to the variable voltage source 6, of the booster transformer 5. This is coupled by means of the booster transformer 5 into the secondary winding 5*b*, which is inserted into the supply line 3, of the booster transformer 5, in which a voltage $U_B$ drops, which is the additional voltage $U_{RB}$ coupled to the secondary side of the booster transformer 5.

The variable voltage source 6 of the longitudinal voltage regulator 1 is formed by a power transformer 7. This has a primary winding 7*a* and a secondary winding 7*b*. The primary winding 7*a* of the power transformer 7 is connected with one of its terminals to the supply line 3. The other terminal of the primary winding 7*a* is connected to a reference potential N. The secondary winding 7*b* of the power transformer 7 is connected to a terminal of the primary winding 5*a* of the booster transformer 5, and, with its second terminal, to the other terminal of the primary winding 5*a* of the booster transformer 5. This second terminal of the secondary winding 7*b* of the power transformer interacts with an interruption-free step switch 8 having five terminals in such a way that the tap point used at the secondary winding 7*b* is switchable without interruption.

A disadvantage of the longitudinal voltage regulator 1 explained with reference to FIG. 2 is that, due to the fact that it requires two transformers, together with the housing into which it is inserted, it has relatively large dimensions and a relatively high weight.

Figure 3:
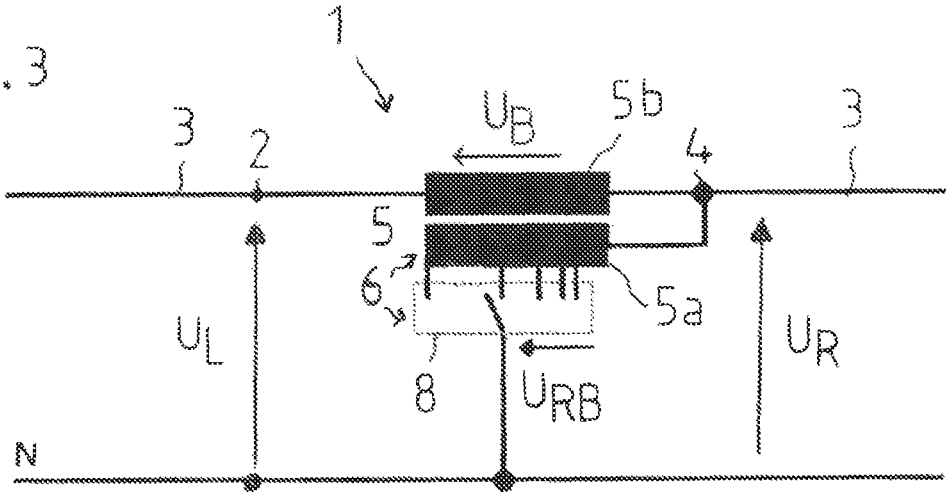
FIG. 3 shows a sketch of a longitudinal voltage regulator according to a first exemplary embodiment of the invention.

FIG. 3 shows a sketch of a longitudinal voltage regulator 1 according to a first exemplary embodiment for the invention. The dimensions and weight for this longitudinal voltage regulator are reduced compared to the longitudinal voltage regulator shown in FIG. 2.

This longitudinal voltage regulator 1 can be inserted into a supply line 3 of a medium-voltage network, which is provided, for example, between a (not depicted) high-voltage-to-medium-voltage transformer (HV-MV transformer) and a low-voltage network (likewise not depicted), in which loads are arranged. There is an input voltage or system voltage $U_L$, which is subjected to voltage fluctuations, present at the input terminal 2 of the longitudinal voltage regulator 1. A regulated output voltage or a regulated system voltage $U_R$ is provided at the output terminal 4 of the longitudinal voltage regulator 1. The following applies:

$$U_R=U_L-U_B.$$

$U_B$ is a voltage which drops across the output winding 5*b*, which is inserted into the supply line 3, of a booster transformer 5. This voltage $U_B$ is an additional voltage which is coupled into the supply line 3 or transformed into the supply line 3. To generate this additional voltage, the longitudinal voltage regulator 1 has a variable voltage source 6 formed by the aforementioned booster transistor 5, which interacts with a step switch 8. The voltage source 6 that is supplied with power by the supply line 3 is a variable voltage source, by means of which an additional voltage $U_{RB}$ is generated that is applied across the input winding 5*a* of the booster transformer 5 and by means of the booster transformer 5 is coupled into the supply line 3 or transformed into the supply line 3.

The booster transformer 5 is therefore designed to perform both the generation of the additional voltage as well as its coupling into the supply line 3.

For this purpose, in the illustrated first exemplary embodiment, one terminal of the input winding 5*a* of the booster transformer 5 is connected via the step switch 8 to the reference potential N, and the other terminal of the input winding 5*a* of the booster transformer 5 is connected to an output terminal 4 of the longitudinal voltage regulator 1. Furthermore, one terminal of the output winding 5*b* of the booster transformer 5 is connected to an input terminal 2 of the longitudinal voltage regulator 1, and the other terminal of the output winding 5*b* is connected to the output terminal 4 of the longitudinal voltage regulator 1. The additional voltage $U_B$ coupled into the supply line 3 or transformed into the supply line 3 drops across the output winding 5*b* of the booster transformer 5.

The variable voltage source 6 of the longitudinal voltage regulator 1 is formed by the primary winding 5*a* of the booster transformer 5, which interacts with the step switch 8. In the exemplary embodiment shown, the primary winding 5*a* has five taps, which are connected to output terminals of the step switch 8. The input of the step switch 8 is connected to the reference potential N. The step switch 8 can be switched such that one of its total of 5 output terminals is connected to the output terminal 4 via the windings, remaining between the reference potential N and the output terminal 4, of the primary winding 5*a*. By switching the step switch 8, the additional voltage generated by means of the variable voltage source can be changed, e.g., from tap-to-tap of the primary winding 5*a* by 2%. For this purpose, the taps of the primary winding 5*a* of the booster transformer 5 or the associated output terminals of the step switch 8 are distributed non-linearly over the number of turns of the primary winding 5*a* such that a change in the selection of the tap used from tap-to-tap in each case enables a linear change in the provided additional voltage $U_{RB}$. This possibility of changing the additional voltage advantageously allows the additional voltage to be adapted to the voltage fluctuations occurring on the supply line 3.

Figure 4:
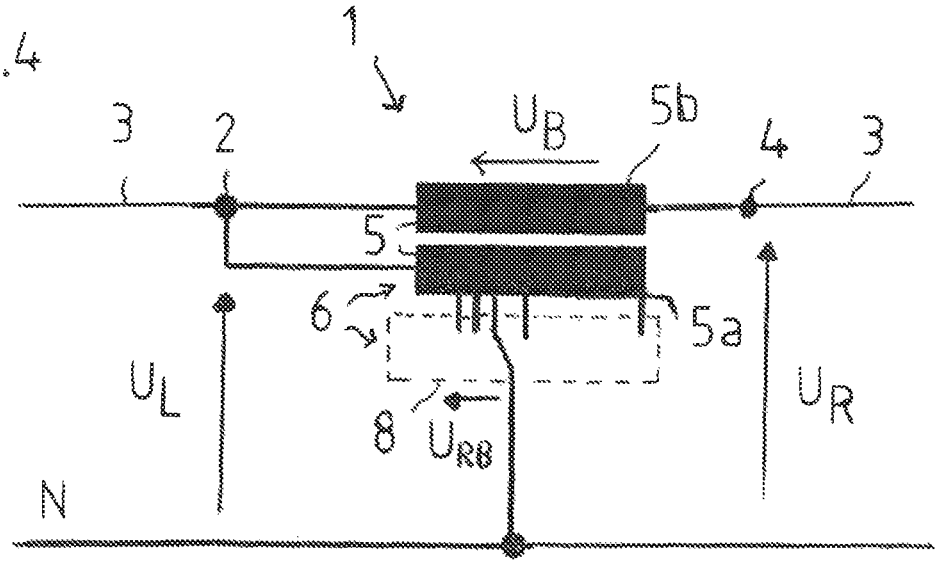
FIG. 4 shows a sketch of a longitudinal voltage regulator according to a second exemplary embodiment of the invention.

FIG. 4 shows a sketch of a longitudinal voltage regulator 1 according to a second exemplary embodiment for the invention. Also in this longitudinal voltage regulator, the dimensions and weight are reduced compared to the longitudinal voltage regulator shown in the FIG. 2.

This longitudinal voltage regulator 1 also can be inserted into a supply line 3 of a medium-voltage network, which is provided, for example, between a (not depicted) high-voltage-to-medium-voltage transformer (HV-MV transformer) and a (likewise not depicted) low-voltage network in which loads are arranged. An input voltage that is subjected to voltage fluctuations or the system voltage $U_L$ that is subjected to fluctuations is present at the input terminal 2 of the longitudinal voltage regulator 1. A regulated output voltage or a regulated system voltage $U_R$ is provided at the output terminal 4 of the longitudinal voltage regulator 1. The following applies:

$$U_R=U_L-U_B.$$

$U_B$ is a voltage which drops across the output winding 5*b*, which is inserted into the supply line 3, of a booster transformer 5. This voltage $U_B$ is an additional voltage which is coupled into the supply line 3 or transformed into the supply line 3. To generate this additional voltage, the longitudinal voltage regulator 1 has a variable voltage source 6 formed by the aforementioned booster transistor 5, which interacts with a step switch 8. The voltage source 6 that is supplied with power by the supply line 3 is a variable voltage source, by means of which an additional voltage $U_{RB}$ is generated that is applied across the input winding 5*a* of the booster transformer 5 and by means of the booster transformer 5 is coupled into the supply line 3 or transformed into the supply line 3.

The booster transformer 5 is therefore designed to perform both the generation of the additional voltage as well as its coupling into the supply line 3.

For this purpose, in the illustrated second exemplary embodiment, one terminal of the input winding 5*a* of the booster transformer 5 is connected via the step switch 8 to the reference potential N, and the other terminal of the input winding 5*a* of the booster transformer 5 is connected to the input terminal 2 of the longitudinal voltage regulator 1. Furthermore, one terminal of the output winding 5*b* of the booster transformer 5 is connected to the input terminal 2 of the longitudinal voltage regulator 1, and the other terminal of the output winding 5*b* is connected to the output terminal 4 of the longitudinal voltage regulator 1. The additional voltage $U_B$ coupled into the supply line 3 or transformed into the supply line 3 drops across the output winding 5*b* of the booster transformer 5.

The variable voltage source 6 of the longitudinal voltage regulator 1 is formed by the primary winding 5*a* of the booster transformer 5, which interacts with the step switch 8. In the exemplary embodiment shown, the primary winding 5*a* has five taps, which are connected to output terminals of the step switch 8. The input of the step switch 8 is connected to the reference potential N. The step switch 8 can be switched such that one of its total of 5 output terminals is connected to the input terminal 2 via the windings, remaining between the reference potential N and the input terminal 2, of the primary winding 5*a*. By switching the step switch 8, the additional voltage generated by means of the variable voltage source can be changed, e.g., from tap-to-tap of the primary winding 5*a* by 2%. For this purpose, the taps of the primary winding 5*a* of the booster transformer 5 or the associated output terminals of the step switch 8 are distributed non-linearly over the number of turns of the primary winding 5*a* such that a change in the selection of the tap used from tap-to-tap in each case enables a linear change in the provided additional voltage $U_{RB}$. This possibility of changing the additional voltage advantageously allows the additional voltage to be adapted to the voltage fluctuations occurring on the supply line 3.

The invention described with reference to the exemplary embodiments described above has several advantages.

A significant advantage of a longitudinal voltage regulator according to the invention is that it requires only one transformer. This is designed both for generating the additional voltage and for coupling this additional voltage into the supply line. This allows a more compact design compared to known longitudinal voltage regulators. This more compact design, in turn, is accompanied by a reduction in the dimensions of the longitudinal voltage regulator and reduction of its weight. This reduction in the weight and dimensions of the longitudinal voltage regulator also reduces the dimensions and weight of the housing in which the longitudinal voltage regulator is installed. For example, a concrete housing with an integrated longitudinal voltage regulator according to the prior art has a length of 2.50 m, a width of 6.00 m, and a height of 3.20 m. A concrete housing with an integrated longitudinal voltage regulator according to the invention by contrast has, at the same length and height, a reduced width—for example, 4.00 m.

Due to said reduction in its weight and its dimensions, the transportability of a longitudinal voltage regulator installed in a housing is improved. Thus, such a longitudinal voltage regulator can be transported to the desired installation site, for example, also on the load bed of a regular truck, which means substantially less effort than the transport of a longitudinal voltage regulator on a flatbed truck, as was necessary in the case of known longitudinal voltage regulators. At the installation site itself, the housing of the longitudinal voltage regulator, including the longitudinal voltage regulator incorporated therein, is placed on a prepared foundation by means of a crane.

The improved transportability of a longitudinal voltage regulator is particularly advantageous when, in the presence of a need to expand an electricity distribution network, additional energy sources—in particular, alternative energy sources—are to be connected to the electricity distribution network. This often means that voltage fluctuations which are no longer tolerable occur in the region of the supply lines, which voltage fluctuations have to be reduced by suitable voltage regulation. Placing one or more longitudinal voltage regulators having the features according to the invention at appropriate positions within the electricity distribution network lends itself to a voltage regulation of this type.

Further advantages of a longitudinal voltage regulator according to the invention are that its acquisition costs are lower than the acquisition costs of known longitudinal voltage regulators, because it has fewer components than conventional longitudinal voltage regulators. In particular, the costs for the power transformer used in conventional longitudinal voltage regulators, which are used in known longitudinal voltage regulators in addition to the boosting transformer, are eliminated.

Furthermore, the energy efficiency of a longitudinal voltage regulator according to the invention is significantly increased compared to the energy efficiency of conventional longitudinal voltage regulators. A longitudinal voltage regulator according to the invention produces less waste heat than a known longitudinal voltage regulator, because it requires fewer transformers and therefore has less loss.

Furthermore, the probability of defects occurring is also reduced because of the reduction in the number of components used.

Furthermore, the structure of a longitudinal voltage regulator according to the invention is simplified compared to a structure of known longitudinal voltage regulators.

Longitudinal voltage regulators having the features according to the invention can be used, in particular, in single-phase or multi-phase current distribution networks, such as medium-voltage networks or low-voltage networks.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

Longitudinal voltage regulator, in-line regulator
Input terminal of the longitudinal voltage regulator
Supply line
Output terminal of the longitudinal voltage regulator
Booster transformer
5*a* Input winding of the booster transformer
5*b* Output winding of booster transformer
Variable voltage source
Power transformer
7*a* Input winding of the power transformer
7*b* Output winding of the power transformer
Step switch
N Reference potential
$U_B$ Transformed additional voltage on the supply line
$U_L$ Input voltage, system voltage
$U_R$ Output voltage, regulated system voltage
$U_{RB}$ Additional voltage

What is claimed is:

1. A longitudinal voltage regulator, comprising:

a voltage source configured to generate an additional voltage; and a transformer configured to couple the additional voltage into an input voltage of the longitudinal voltage regulator, wherein the transformer comprises the voltage source and is configured both to generate the additional voltage using the voltage source and to couple the additional voltage into the input voltage of the longitudinal voltage regulator, wherein the transformer has a number of taps connected to output terminals of a step switch of the longitudinal voltage regulator; and wherein positions of the taps are non-linearly distributed over a number of turns of a primary winding of the transformer such that a change in a selection of a tap of the number of taps enables a linear change in the additional voltage.

2. The longitudinal voltage regulator according to claim 1, wherein the transformer has an input winding and an output winding, and wherein the output winding is arranged in a supply line of the one of a single-phase or multi-phase electricity distribution network.

3. The longitudinal voltage regulator according to claim 2, wherein a first terminal of the input winding of the transformer is connected to a reference potential, and a second terminal of the input winding is connected to an output terminal of the longitudinal voltage regulator, and wherein a first terminal of the output winding of the transformer is connected to an input terminal of the longitudinal voltage regulator, and a second terminal of the output winding is connected to the output terminal of the longitudinal voltage regulator.

4. The longitudinal voltage regulator according to claim 2, wherein a first terminal of the input winding of the transformer is connected to a reference potential, and a second terminal of the input winding is connected to an input terminal of the longitudinal voltage regulator, and wherein a first terminal of the output winding of the transformer is connected to the input terminal of the longitudinal voltage regulator, and a second terminal of the output winding is connected to the output terminal of the longitudinal voltage regulator.

5. The longitudinal voltage regulator according to claim 2, wherein the input winding of the transformer has the number of taps connected to the output terminals of the step switch, and wherein an input terminal of the step switch is connected to a reference potential.

6. The longitudinal voltage regulator according to claim 5, wherein the number of taps of the input winding of the transformer is five.

7. The longitudinal voltage regulator according to claim 1, wherein a polarity of the additional voltage is variable.

8. The longitudinal voltage regulator according to claim 7, wherein the polarity of the additional voltage is variable by a change in the current direction.

9. A method, performed by a longitudinal voltage regulator operating in one of a single-phase or multi-phase electricity distribution network, the method comprising:

generating an additional voltage using a voltage source of a transformer of the longitudinal voltage regulator, wherein the transformer has a number of taps connected to output terminals of a step switch of the longitudinal voltage regulator and the positions of the taps are non-linearly distributed over a number of turns of a primary winding of the transformer;

coupling the additional voltage into an input voltage of the longitudinal voltage regulator using the transformer of the longitudinal voltage regulator; and linearly changing the additional voltage by changing a selection of a tap of the number of taps.

10. The method according to claim 9, wherein the transformer has an input winding and an output winding, and wherein the output winding is arranged in a supply line of the one of the single-phase or multi-phase electricity distribution network.

11. The method according to claim 10, wherein a first terminal of the input winding of the transformer is connected to a reference potential, and a second terminal of the input winding is connected to an output terminal of the longitudinal voltage regulator, and wherein a first terminal of the output winding of the transformer is connected to an input terminal of the longitudinal voltage regulator, and a second terminal of the output winding is connected to the output terminal of the longitudinal voltage regulator.

12. The method according to claim 10, wherein a first terminal of the input winding of the transformer is connected to a reference potential, and a second terminal of the input winding is connected to an input terminal of the longitudinal voltage regulator, and wherein a first terminal of the output winding of the transformer is connected to the input terminal of the longitudinal voltage regulator, and a second terminal of the output winding is connected to the output terminal of the longitudinal voltage regulator.

13. The method according to claim 10, wherein the input winding of the transformer has the number of taps connected to the output terminals of the step switch, and wherein an input terminal of the step switch is connected to a reference potential.

14. The method according to claim 13, wherein the number of taps of the input winding of the transformer is five.

15. The method according to claim 9, wherein a polarity of the additional voltage is variable.

16. The method according to claim 15, wherein the polarity of the additional voltage is variable by a change in the current direction.

17. A transformer of a longitudinal voltage regulator, the transformer comprising:

a voltage source configured to generate an additional voltage;

a primary winding; and a number of taps non-linearly distributed over a number of turns of the primary winding, the number of taps configured to connect to output terminals of a step switch of the longitudinal voltage regulator;

wherein the transformer generates the additional voltage using the voltage source and couples the additional voltage into an input voltage of the longitudinal voltage regulator;

wherein the transformer linearly changes the additional voltage based on a change in a selection of a tap of the number of taps non-linearly distributed over a number of turns of the primary winding.

* * * * *